United States Patent [19]

Mancini

[11] Patent Number: 4,673,088

[45] Date of Patent: Jun. 16, 1987

[54] SKI STORAGE RACK

[76] Inventor: Donato Mancini, 1267 Coupal Street, Carignan,Province of Quebec, Canada, J3L 3P9

[21] Appl. No.: 893,361

[22] Filed: Aug. 5, 1986

[51] Int. Cl.[4] ..... A47F 7/00

[52] U.S. Cl. ..... 211/70.5; 211/60.1

[58] Field of Search ..... 211/70.5, 4, 70.8, 64, 211/60.1; 224/917

[56] References Cited

U.S. PATENT DOCUMENTS

| | | | |
|---|---|---|---|
| 492,304 | 2/1893 | Markle | 211/64 X |
| 3,905,481 | 9/1975 | Laterra | 211/70.5 |
| 4,078,708 | 3/1978 | Mayer | 211/70.5 |
| 4,132,315 | 1/1979 | Young | 211/64 X |
| 4,190,166 | 2/1980 | Allsop | 211/60.1 |
| 4,222,490 | 9/1980 | Wood, Jr. . | |

*Primary Examiner*—Ramon S. Britts
*Assistant Examiner*—Blair M. Johnson

[57] ABSTRACT

A rack for supporting a number of upright pairs of skis and corresponding ski equipment in a most compact side-by-side relation. The ski rack comprises an open quadrangular wooden frame adapted to be fixed to a wall and defining top, bottom and side studs. Short posts project upwardly from the bottom stud, at spaced intervals. The bottom edges of alternate pairs of upright skis are engageable in first cavities, made on the top of the short posts and the bottom edges of intermediate pairs of skis are engageable in second cavities, made on the top face of the bottom stud intermediate the successive short posts. Successive pairs of skis are thus relatively vertically offset for most efficient use of available space, whereby the curved ski tips and the boot bindings are spacedly staggered and interdigitated. The front face of the top stud includes vertical slots, in register with the first or second cavities. These slots are closed by a releasable latch, whereby the top portions of pairs of skis are retained in the slots.

6 Claims, 5 Drawing Figures

SKI STORAGE RACK

FIELD OF THE INVENTION

The invention pertains to vertical ski racks.

BACKGROUND OF THE INVENTION

In the prior art relevant to ski racks, U.S. Pat. No. 3,905,481 to Laterra shows a vertical ski rack having brackets 12, 14 to secure individual skis in side-by-side, co-planar upright positions. This ski rack does not make optimum use of the available space, does not support the skis assembled pairs and does not have provision for storing ski poles or other ski equipment.

In U.S. Pat. No. 4,222,490 to Wood Jr, the ski rack support pairs of skis in a circle.

In U.S. Pat. No. 4,078,708 to Mayer, the ski rack is specifically made for the rear door of a motor van. The ski rack quadrangular open frame has clamps that support pairs of skis at the same level; therefore, use of available space is not as efficient as it could be, since the ski tips and boot bindings substantially register horizontally one with the other, and this prevents bringing the pairs of skis close one to the others.

OBJECTS OF THE INVENTION

An important object of the present invention is to provide a ski rack which will support a number of pairs of skis in a most compact fashion.

Another important object of the ski rack is to include means to support ski poles and other ski equipment with the skis proper.

Still another important object of the ski rack is to provide simple but effective locking means for releasably locking the skis and poles to the rack frame.

SUMMARY OF THE INVENTION

Accordingly with the objects of the invention, there is disclosed an upright rack for supporting pairs of skis in compact fashion in relatively spaced upright position. The ski rack comprises: a main open quadrangular rigid frame, made of interconnected top, bottom and side members; the top face of said bottom member having at least one first cavity for receiving the bottom edges of one pair of upright skis, and at least one short post upwardly projecting from said bottom member spacedly from said first cavity and defining a top end having a second cavity for receiving the bottom edges of another pair of skis, whereby the curved ski tips and the boot bindings of one of said pairs of skis are vertically offset from the same elements of the other pair of skis. Slots are made in the front face of said top member and extend through the top and bottom faces thereof but short of the rear face thereof, each of said slots in vertical register with one of said first and second cavities for receiving the upper portion of a given pair of skis. Closure members close said slots, whereby said skis are retained and can slide within their said slots to rest within said cavities.

BRIEF DESCRIPTION OF THE DRAWINGS

FIG. 4 is an enlarged partly-sectional fragmentary view of the top portion of a ski rack according to a second embodiment of the invention, showng a pair of skis and associated poles mounted therein, the top member hinge latch locked by a padlock illustrated in closed position in phantom lines; and.

DETAILED DESCRIPTION OF THE PREFERRED EMBODIMENTS OF THE INVENTION

Figure 1:
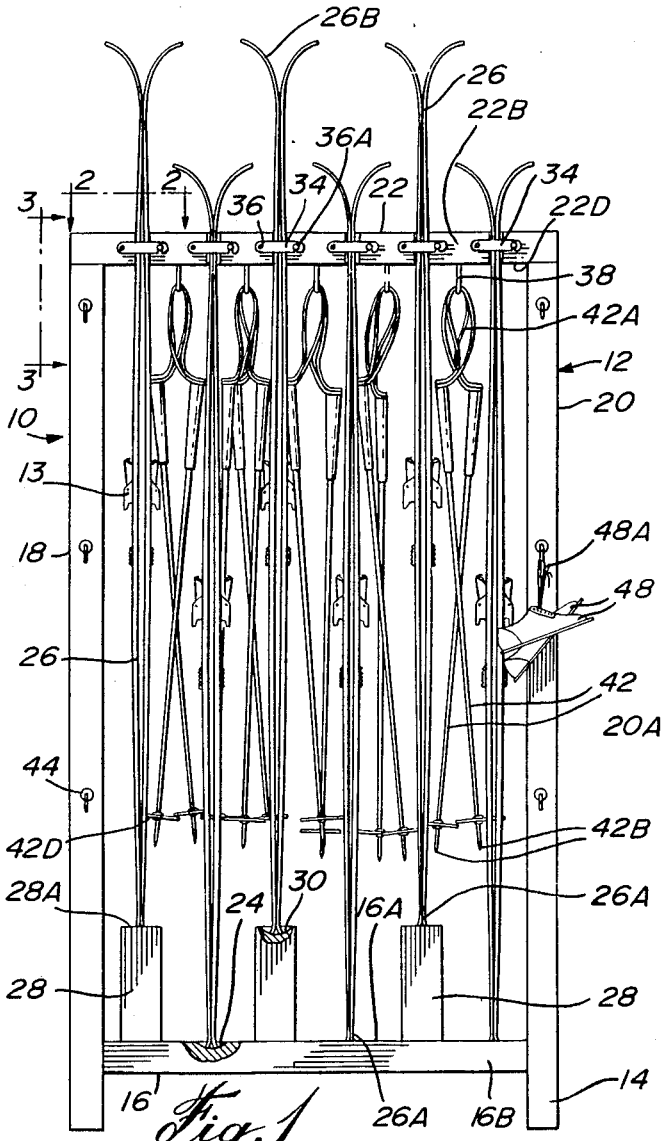
FIG. 1 is a partly-sectional front elevation of a ski rack according to a first embodiment of the invention, supporting a few pairs of skis, associated poles and one pair of cross-country ski boots.

Referring to FIG. 1, there is shown an embodiment of a ski rack 10, consisting of a main quadrangular open frame 12, either supported in spaced upright position over ground by feet 14 or fixed to a wall, or the like support. Frame 12 is made of interconnected cross-sectionally quadrangular studs 16, 18, 20, 22, made for example of full wood. The top face 16A of the bottom stud 16 includes equally spaced-apart concave cavities 24, each extending transversely to the plane defined by frame 12 to support the bottom edge 26A of a pair of skis 26 in upright position Each cavity 24 extends short of the front face 16B or rear face (not shown) of the bottom stud 16. A number of short posts 28 upstand from stud top face 16A, parallel to upright studs 18 and 20 and are located between and spaced from cavities 24. The top edge 28A of each post 28 includes a concave cavity 30, similar to cavity 24, also for receiving ski bottom edges 26A.

Figure 2:
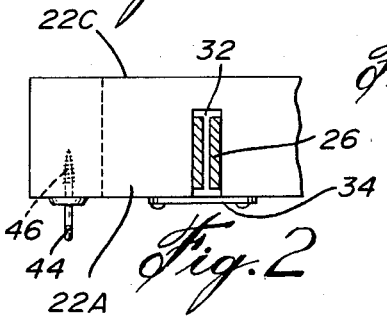
FIG. 2 is cross-sectional views taken along line 2—2 of FIG. 1.

The front face of top stud 22, at 22B, includes a plurality of transverse slots 32 (FIG. 2), each in vertical register with a given one of cavities 24 and 30. Slots 32 extend short of stud rear face 22C, whereby a pair of skis 26 are engageable therein. Slots 32 are longer than the width of the skis 26. The relative height of top stud 22 should be such that the top front outwardly-diverging tips 26B of a pair of the shortest expected skis supported by cavities 24, extend above the stud top face 22A and that the boot bindings 13 carried by the longest such skis supported in cavities 30 will extend below top stud 22. Metal latch plates 34 are pivoted at one end on a screw 36 to stud front face 22B and are notched at their outer ends to engage another screw 36A and, thus, close the front opening of slots 32. Hence the skier, in order to use the rack 10, opens latch plate 34 and inserts the upper portion of his skis 26 through slot 32 and the bottom edge 26A of his skis 26 within the vertically-registering one of cavities 24 or 30.

A plurality of small screw hooks 38 are secrewed in inverted position to top stud bottom face 22D, intermediate two successive slots 32. Each hook 38 is of a shape to support the hand straps 42A of a few ski poles 42, whereby the bottom pointed end thereof at 42B is freely supported spacedly over bottom stud 16.

Figure 3:
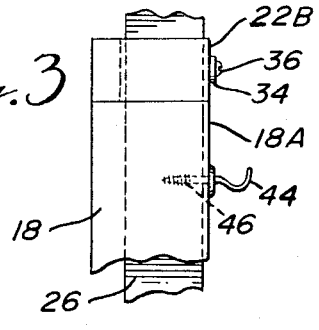
FIG. 3 is a partial elevation taken on line 3—3 of FIG. 1.

The front face 18A,20A of each upright stud 18 and 20 includes a few vertically-spaced hooks 44 (FIG. 3) including a threaded shaft 46 and similar to hooks 38 and which are screwed thereinto. Hooks 44 are shown to support a pair of cross-country, ski boots 48 by their boot-lace 48A, but they could, of course, support a bag, knapsak, or other sporting equipment. It is advantageous that feet 14 be coaxial and integral to upright studs 18–20.

Figure 4:
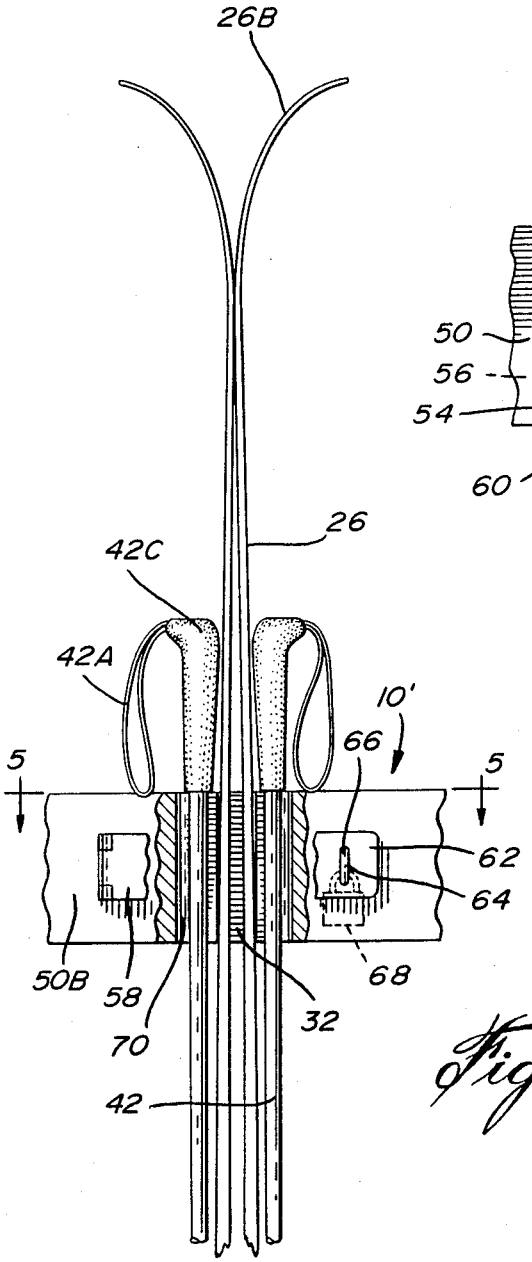
Figure 5:
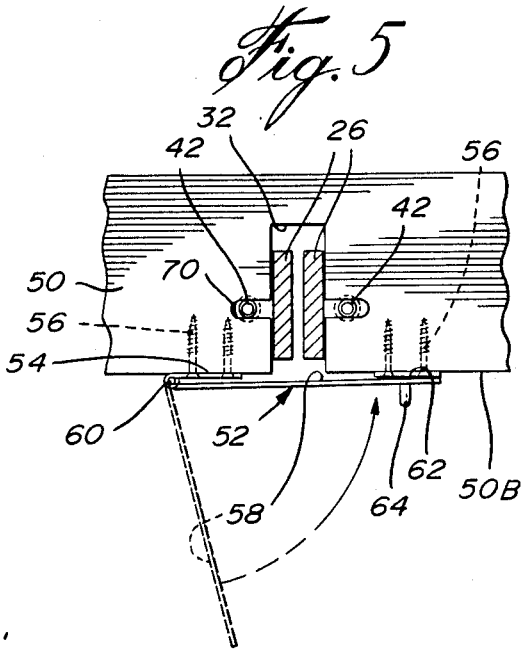
FIG. 5 is a horizontal sectional view taken along line 5—5 of FIG. 4, showing the hinged closure plate in closed position in full lines and in its opened position in dotted lines.

The alternate embodiment of ski rack 10' of FIGS. 4–5 is directed to large ski resorts, in which prevalence of theft of ski equipment from clients may adversely affect the goodwill of the ski resorts.

Rack 10' differs from rack 10 by its top stud 50. Each slot 32 is closed by a hinged door 52, which replaces blade 34. More particularly, a bracket plate 54 is screwed by screws 56 to the top stud front face 50B, on one side of each slot 32. Plate 54 is pivotally interconnected to an elongated door plate 58, which may close the front edge of slot 32 by the hinge proper 60. Another bracket plate 62 is screwed by screws 56 to front edge 50B on the other side of each slot 32, to register with the free end of the closed door plate 58.

The skis 26 may then engage slot 32 directly through the stud front face 50B. An inverted U-shaped bolt 64 is fixedly mounted to bracket plate 62 and is engageable through a transverse opening 66 made in door plate 58, the opening 66 coming in register therewith upon closure of the door plate 58. A padlock 68 locks door plate 58 in its closed position, shown in full lines in FIG. 5, by engaging U-bolt 64.

Slot 32 includes short intermediate transverse (vertical) slits 70 for engagement by the shaft of ski ples 42. Slits 70 should be of a width intermediate that of the ski pole shaft proper 42 and that of grip handle 42C to prevent unauthorized withdrawal thereof. Upward removal of the ski poles is prevented by the poles bottom cup 42D see FIG. 1.

Unauthorized unscrewing of screws 56, to remove the skis 26 from the rack 10' by removing the whole hinge door 52, is impossible, since the locked closed door plate 58 not only closes the front oepning of slot 32 but also hides the heads of bracket plate screws 56. Removal of the skis 26 from the rack 10' by upward or downward sliding of these skis is prevented by the shape of top curved tips 26B and by the ski boot bindings Thereafter, removal of poles 42 is possible only after removal of skis 26, by sliding outwardly the poles from their slit 70 into larger slot 32. In view of the latter, the distance in between the inner face of the closed door plate 58 and the level of slits 70 (which need not be registering as shown) should be at least slightly shorter than the width of the skis, to prevent disengagement of poles 42 from slit 70 and engagement into the rearward end of slot 32, wherein downward removal of the pole would be possible.

The height of each rack 10,10' has upper and lower limit values for the reasons outlined above, but its width is not critical and may vary accordingly with the needs of the clients.

Since all the bindings of the skis lie within the space defined by the ski rack frame, should the latter fall, no damage will be incurred by these boot bindings.

What I claim is:

1. A rack for supporting at least two pairs of skis in side-by-side, spaced upright positions, with the running faces of the two skis of anyone pair in face-to-face contact, comprising: a main open quadrangular rigid frame adapted to be positioned upright, made of interconnected top bottom and side members; the top face of said bottom member having at least one first cavity for receiving the bottom edges of one pair of upright skis, and at least one short post upwardly projecting from said bottom member top face spacedly from said first cavity and defining a top end having a second cavity for receiving the bottom edges of another pair of skis, whereby the curved front ski tips and the boot bindings of said one pair of skis are vertically downwardly offset from the ski tips and boot bindigs of said another pair of skis; further including slots made through the front face of said top member and extending through the top and bottom faces thereof but short of the rear face thereof, each of said slots in vertical register with one of said first and second cavities for engagement by the upper portion of a given pair of skis; and closure members to close the open end of said slots, said pairs of skis being vertically slidable within said slots, said slots of a depth and width to receive and retain a pair of skis in a position with their running faces generally normal to the plane of said rack, the spacing between adjacent slots being such that the ski tip and boot binding of one ski of one pair are respectively interdigitated with the ski tip and boot binding of the adjacent facing ski of the other pair.

2. A ski rack as defined in claim 1, further including hook means depending from the bottom face of said top member, intermediate said slots for hanging ski poles by their handle straps spacedly over said bottom member.

3. A ski rack as defined in claim 2, further including additional hook means at the front of said side members in vertically-spaced positions for hanging sporting goods equipment, such as ski boots.

4. A ski rack as defined in claim 1, wherein each of said first and second cavities is elongated, concave, in vertical register with a corresponding one of said slots, but extends short of the front and rear faces of said bottom member and of said short post, respectively.

5. A ski rack as defined in claim 1, wherein each of said closure members comprises: a first and second bracket plates fixedly secured to the front face of said top opposite sides of a top member slot; an inverted U-shaped bolt outwardly projecting from said second bracket plate; an elongated door plate hingedly mounted to said first bracket plate for pivotal of its free end portion to and fro said second bracket plate, said door plate free end portion including an aperture registering with and for releasable engagement of said U-shaped bolt upon closure of said door plate thereagainst; further including a lock member releasably engaging said U-shaped bolt to lockingly bias said door plate free end portion against said second bracket plate.

6. A ski rack as defined in claim 1, further including a pair of opposite slits, extending intermediately, transversely vertically of each of said top member slots, each of said slits slidingly engageable by the shaft of one ski pole; the width of one slit smaller than that of the ski pole-grip handle; the distance between said slits and said closure member being smaller than the width of said skis.

* * * * *